US005544366A

United States Patent [19]

Kato

[11] Patent Number: 5,544,366

[45] Date of Patent: Aug. 13, 1996

[54] ELASTIC WAIST STRUCTURE FOR TROUSERS AND SKIRTS

[76] Inventor: Kohji Kato, 189 Takehana-Cho, Hashima Gifu, Japan

[21] Appl. No.: 449,079

[22] Filed: May 24, 1995

[30] Foreign Application Priority Data

| | | | |
|---|---|---|---|
| May 26, 1994 | [JP] | Japan | 6-112617 |
| Jun. 15, 1994 | [JP] | Japan | 6-133296 |
| Oct. 12, 1994 | [JP] | Japan | 6-246201 |

[51] Int. Cl.[6] ..... A41D 1/06

[52] U.S. Cl. ..... 2/237

[58] Field of Search ..... 2/237, 221, 76

[56] References Cited

U.S. PATENT DOCUMENTS

| | | | |
|---|---|---|---|
| 2,583,689 | 1/1952 | Edgard | 2/237 |
| 3,812,541 | 5/1974 | Stuart | 2/237 |
| 3,839,740 | 10/1974 | Tornberg | 2/237 |
| 4,596,055 | 6/1986 | Aach et al. | 2/237 |
| 5,067,176 | 11/1991 | Carabillo | 2/237 |

*Primary Examiner*—Amy B. Vanatta
*Assistant Examiner*—Shirra L. Jenkins
*Attorney, Agent, or Firm*—D. Peter Hochberg; Mark Kusner; Michael Jaffe

[57] ABSTRACT

An elastic waist structure for a pair of trousers or skirt utilizing at least one elastic strip material which is always kept from sight. The strip material or materials stretch or contract behind a fabric cover or waist fabric. A tuck whose top edge is open is provided below the waist portion of the trousers or skirt, whose slidable inner fabric prevents formation of wrinkles or furrows outside the trousers or skirt. The tuck can be replaced by a pocket.

6 Claims, 8 Drawing Sheets

ELASTIC WAIST STRUCTURE FOR TROUSERS AND SKIRTS

FIELD OF THE INVENTION

This invention generally relates to the waist structure for trousers or skirts. More particularly, this invention relates to an elastic waist structure for trousers or skirts which is gracefully hidden from sight and capable of retaining the shape of the trousers or skirts when contracted or stretched.

BACKGROUND OF THE INVENTION

The waist sizes of ready-made trousers or pants and skirts are conventionally grouped into several size groups chiefly for economizing on their manufacturing costs. The differences in size between adjacent groups are conventionally about a few centimeters. Consumers wanting to buy such ready-made skirts or pants select from among such grouped sizes where their body sizes belong. Therefore, those consumers may conventionally be forced to wear pants or skirts with waist sizes which do not always fit their waist perfectly.

People's body sizes, especially around their waist, are subject to change with time. In order to continuously wear their pants or skirts, consumers may wish to adjust the waist sizes of their pants or skirts so that their pants or skirts fit them perfectly again. Pants or skirts made to order are no exceptions. When the waist sizes of the wearers of skirts or pants made to order change, their skirts or pants will need size adjustment.

Usually, the waist sizes of skirts or trousers are adjusted by unsewing and restitching the relevant portions of their pants or skirts, or by having them unsewn and restitched by others. Such undoing and restitching will naturally require considerable trouble or costs. Further, such adjustment will usually make the appearance of their skirts or pants ungraceful by changing the shape around the waist portions of the skirts or trousers. Even unbecoming furrows may form on the pants or skirts.

There have been introduced pants and skirts whose waist portions are provided with an elastic material or materials such that the elastic portions can absorb the change in the waist size of the wearers by expanding or contracting. However, such skirts and pants with elastic waist portions often look disgraceful because those elastic materials are exposed and in sight. In addition, when the elastic waist materials of skirts or pants are contracted or stretched, the fabric portions sewn to the elastic materials are wrinkled or furrowed ungracefully since those fabric portions do not contract or stretch together with the elastic materials. Therefore, such an elastic waist structure is not conventionally adopted into elegant or dear trousers or skirts.

Accordingly, it is an object of the present invention to provide an elastic waist structure for trousers or skirts whose elastic strip material or materials are elegantly hidden from sight.

It is another object of the present invention to provide an elastic waist structure for trousers or skirts which can gracefully absorb wrinkles or furrows which will otherwise be formed on the trousers or skirts when the elastic material or materials of the elastic waist structure are contracted or stretched.

SUMMARY OF THE INVENTION

An elastic waist structure of the present invention for pants or skirts comprises at least one elastic strip material to be provided on the waist portion thereof. Each elastic strip material is elegantly kept from sight with a waist fabric portion or fabric cover which can slide over the elastic strip material when the elastic strip material is contracted or stretched within the fabric cover or waist fabric portion.

When an elastic waist structure according to the present invention including at least one elastic strip material is adopted on a skirt having at least one tuck under the waist portion whose top end is unsewn, wrinkles or furrows which will otherwise be formed on the skirt due to the contraction or stretch of the elastic strip material is gracefully absorbed by the inside portion or inner fabric of the tuck which can slide out or slide in sideways such that the skirt does not show any wrinkles or furrows.

The tuck structure of the present invention has the top portion unsewn and can open freely so that the inside portion or inner fabric of the tuck can slide in or slide out sideways smoothly. The wrinkles or furrows which will otherwise be formed on pants or skirt by the contraction or stretch of the elastic strip material or materials can be effectively absorbed as the open top portion of the tuck provides horizontal sliding of the inner fabric of the tuck. The function of such tucks can alternatively be provided by utilizing a side pocket or pockets of trousers or skirt prepared in accordance with the present invention.

BRIEF DESCRIPTION OF THE DRAWINGS

FIG. 3 (B) shows how the elastic waist structure of this embodiment works when the elastic strip material is fully stretched.

FIG. 5 (B) shows how the elastic waist structure of this embodiment works when the elastic strip material is fully stretched.

FIG. 7 (B) shows how the elastic waist structure of this embodiment works when the two elastic strip materials are fully stretched.

FIG. 11 (B) shows how the elastic waist structure of this embodiment works when the elastic strip material is fully stretched.

FIG. 13 (B) shows how the elastic waist structure of this embodiment works when the elastic strip material is fully stretched.

FIG. 15 (B) shows how the elastic waist structure of this embodiment works when the two elastic materials are fully stretched.

DETAILED DESCRIPTION OF THE PREFERRED EMBODIMENTS

The present invention is described hereunder in more detail with embodiments using the accompanying drawings.

Figure 1:
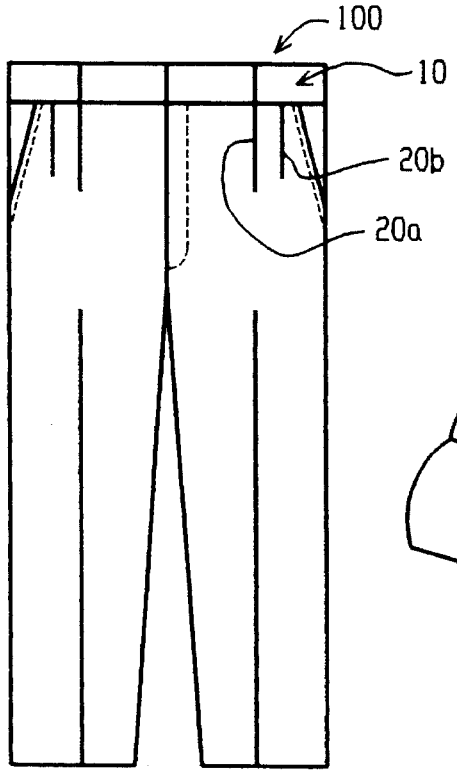
FIG. 1 is a front view of a pair of tucked trousers having two elastic waist structures according to an embodiment of the present invention.

FIG. 1 shows a pair of tucked trousers 100 having a first tuck 20*a* and a second tuck 20*b* on each front side thereof under the waist portion 10, where an elastic waist structure according to an embodiment of the present invention is used. The second tuck 20*b* is a conventional one, while the first tuck 20*a* is comprised of outer fabric 21 and folded inner fabric 23, whose top edge is unsewn and openable unlike a conventional tuck.

Figure 2:
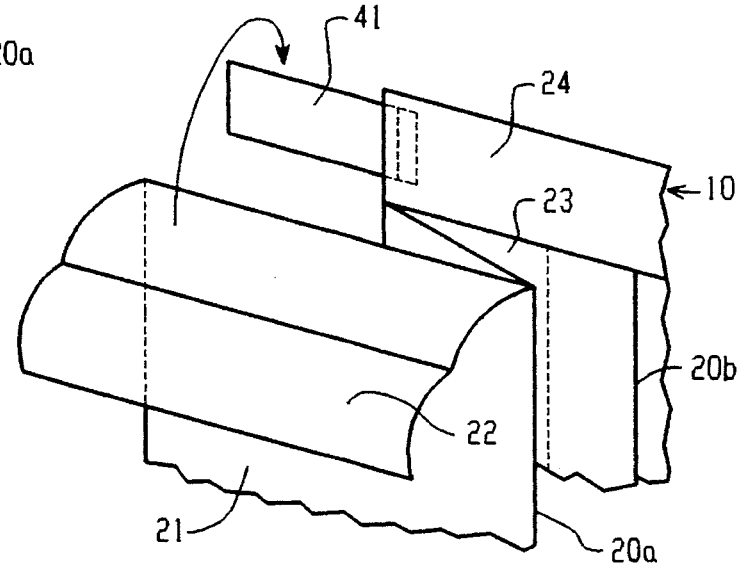
FIG. 2 is a partial perspective view showing the elastic waist structure of this embodiment where the fabric cover is broken away.

There is provided waist fabric 24 above the folded inner fabric 23, which forms part of the waist portion 10 of the pants 100 as shown in FIG. 2. A fabric cover 22 extends upwards from the upper edge of the outer fabric 21 to cover, when folded over the upper edge of the waist portion, both sides of the elastic strip material 41 provided from the front end of the waist fabric 24 toward the center front of the pants 100. The fabric cover 22 may alternatively cover only the front side of the elastic strip material 41.

The elastic strip material 41 is sewn or attached at its front end to the back side of the fabric cover 22 when the fabric cover 22 is in position. The elastic strip material 41 is sewn or attached at its rear end to the front end of the waist fabric 24.

Figure 3A:
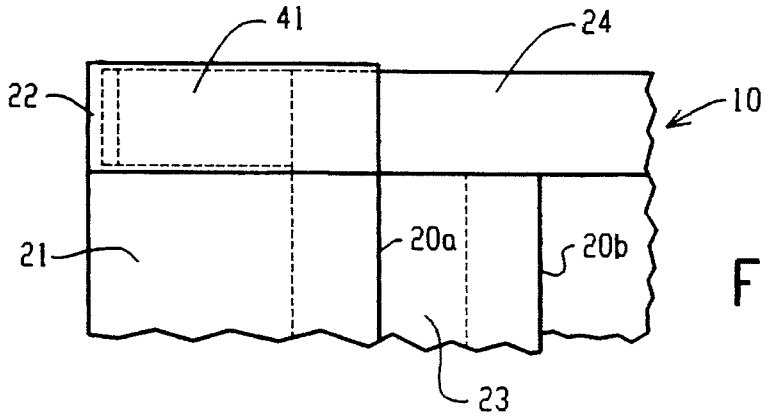
FIG. 3 (A) shows how the elastic waist structure of this embodiment works when the elastic strip material is fully contracted.
Figure 3B:
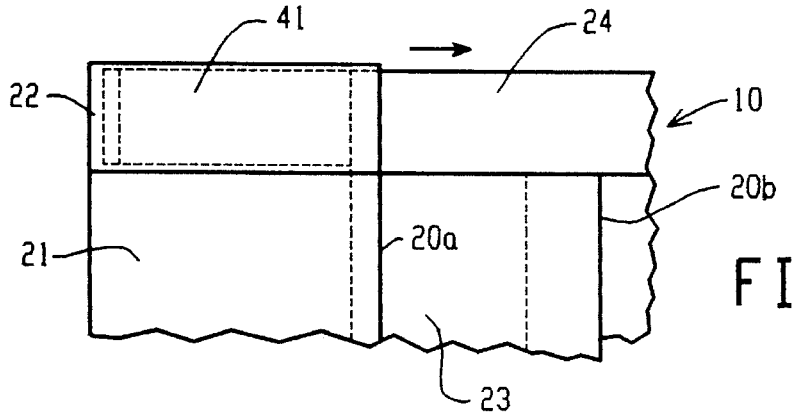

FIGS. 3*a* and 3*b* show how the elastic waist structure of this embodiment works. The fabric cover 22 covering both sides of the elastic strip material 41 slides sideways on the elastic strip material 41 as the elastic strip material 41 stretches or contracts. The inner fabric 23 which is horizontally slidable under the outer fabric 21 thanks to the opening of the top of the tuck 20*a* comes out further to the right as shown in FIG. 3*b* when the waist fabric 24 is pulled toward right. Therefore, the outer fabric 21 will remain unwrinkled when the elastic strip material 41 changes its length by contracting or stretching.

The fabric cover 22 is wide or long enough horizontally to cover the whole elastic strip material 41 even when the elastic strip material 41 is fully stretched, thus the elastic strip material 41 is always kept from sight. The change in length of the elastic strip material 41 is effectively and fashionably absorbed by the slidable inner fabric 23. Therefore, no wrinkles or furrows appear outside the pants 100.

Figure 4:
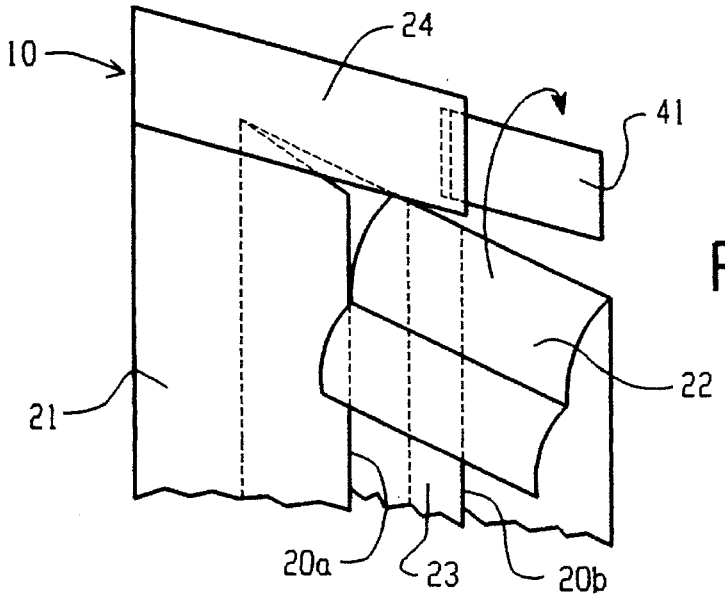
FIG. 4 is a partial perspective view of another embodiment elastic waist structure of the present invention where the fabric cover is broken away.

FIG. 4 shows another embodiment of the present invention. The elastic strip material 41 here is attached at its front end to the rear end of the waist fabric 24 and extends rearwards. The fabric cover 22 extends upwards above the second tuck 20*b* whose upper edge or top edge is sewn to the pants or skirt like a conventional tuck. The fabric cover 22 extends beyond the upper edge of the waist portion 10 of the pants or skirt (not shown) and covers both sides of the elastic strip material 41. Here again, the fabric cover 22 may alternatively cover only the front side of the elastic strip material 41. The elastic strip material 41 is sewn or attached at its rear end to the back side of the fabric cover 22.

Figure 5A:
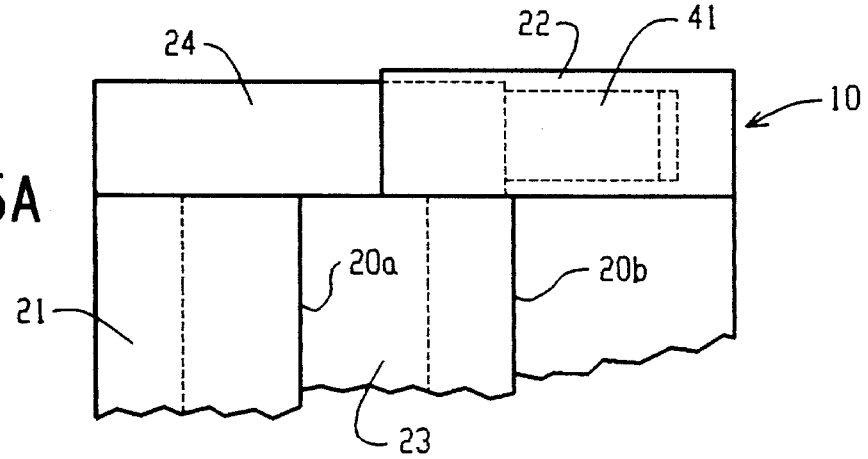
FIG. 5 (A) shows how the elastic waist structure of this embodiment works when the elastic strip material is fully contracted.
Figure 5B:
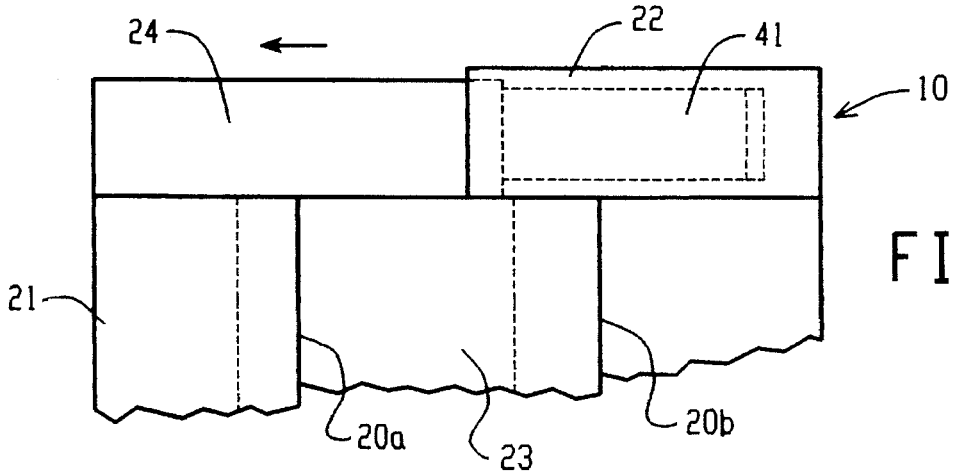

FIGS. 5*a* and 5*b* show how the elastic waist structure of this embodiment works. The waist fabric 24 slides toward left as indicated by the arrow, or the fabric cover 22 slides right together with the elastic strip material 41 pulling the elastic strip material 41 toward right. The fabric cover 22 is long or wide enough horizontally to wholly cover the elastic strip material 41 even when the elastic strip material 41 is fully stretched. The slidable inner fabric 23 of the first tuck 20*a* whose top edge is unsewn further comes out as shown in FIG. 5*b* as the elastic strip material 41 is stretched further, eliminating formation of wrinkles or furrows on the pants or skirt (not shown).

Figure 6:
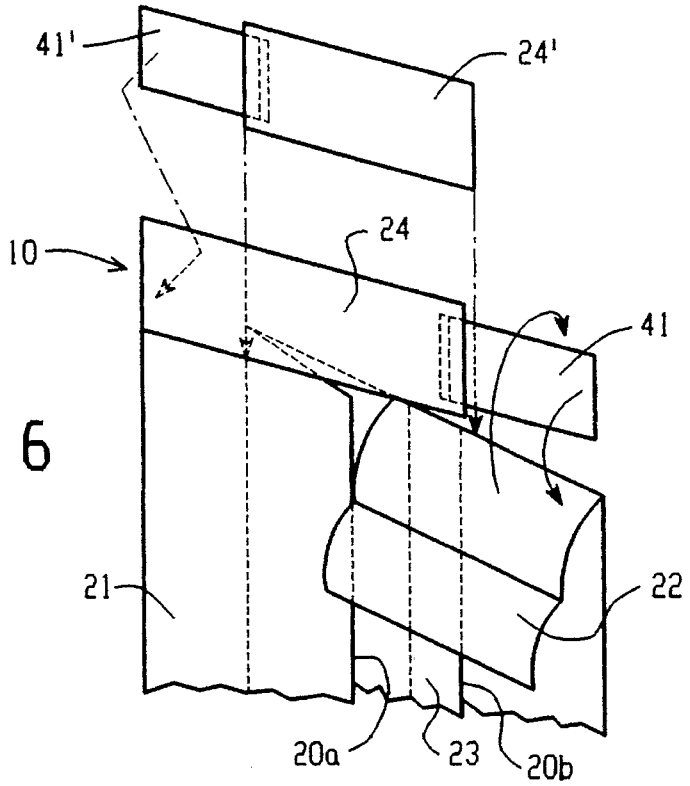
FIG. 6 is a partial perspective view of another embodiment elastic waist structure of the present invention incorporating a pair of elastic strip materials.

FIG. 6 shows another embodiment of the elastic waist structure according to the present invention, which is a modification of the embodiment shown in FIG. 4. Here, two elastic strip materials 41 and 41' are utilized instead of just one. The elastic strip material 41' is additionally utilized, covered with the waist portion and attached at its rear end to the front end of an additional waist fabric 24' and at its front end to the front end of the waist fabric 24.

The elastic strip material 41 is attached at its front end to the rear end of the waist fabric 24 and at its rear end to the back side of the fabric cover 22.

The elastic strip material 41 can stretch and contract within the fabric cover 22, while the elastic strip material 41' can stretch and contract on the back side of the waist fabric 24. The tuck 20*a* whose top edge is unsewn will absorb with the inner fabric 23 the deformation of the pants or skirt (not shown) when the elastic materials 41 and 41' are stretched or contracted.

Figure 7A:
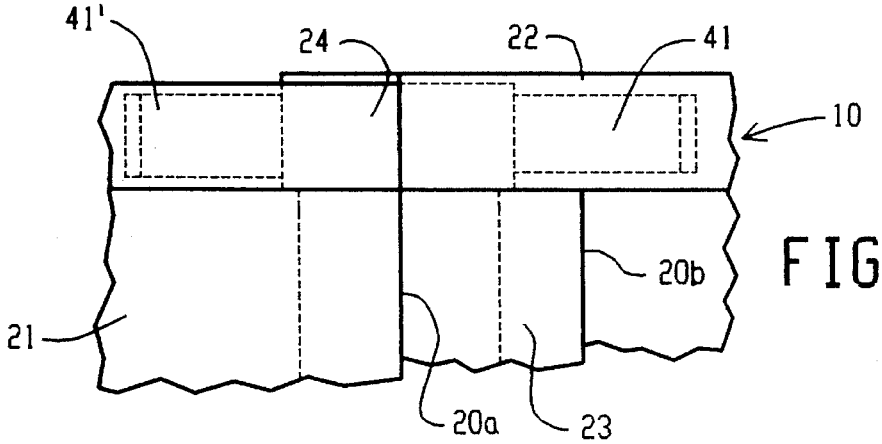
FIG. 7 (A) shows how the elastic waist structure of this embodiment works when the two elastic strip materials are fully contracted.
Figure 7B:
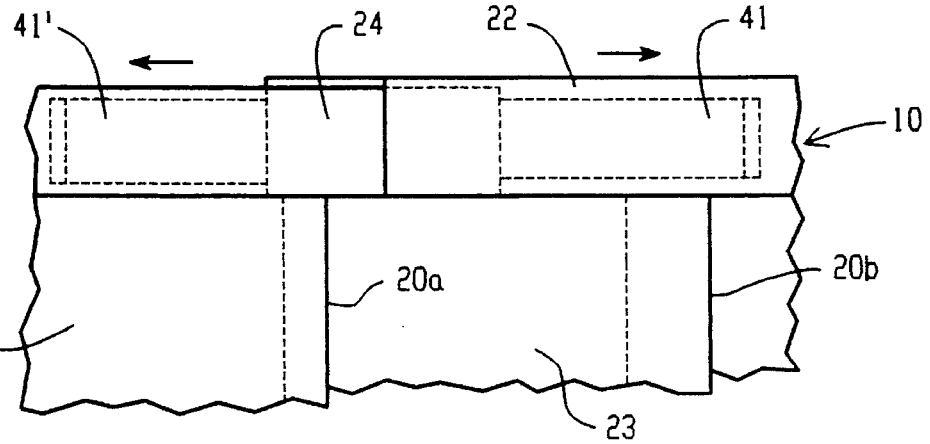

FIGS. 7*a* and 7*b* show how the elastic waist structure of this embodiment works, of which FIG. 7*a* shows the state of the elastic waist structure when the elastic strip materials 41 and 41' are both contracted, while FIG. 7*b* shows the state of the elastic waist structure when the elastic strip materials 41 and 41' are both fully stretched. The elastic strip material 41' will be wholly covered by the waist fabric 24, and the elastic strip material 41 will be wholly covered by the fabric cover 22 even when both the elastic strip materials 41 and 41' are fully stretched. The sliding movement of the inner fabric 23 of the first tuck 20*a* will eliminate formation of wrinkles or furrows outside the pants or skirt (not shown).

Figure 8:
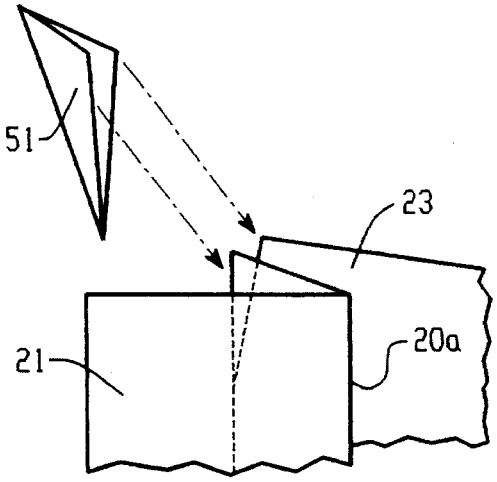
FIG. 8 is a partial perspective view of a wrinkle absorbing structure.

FIG. 8 shows a triangular attachment 51 to provide an assistant wrinkle absorbing means which is provided on the first tuck 20*a* as shown in the figure where the hardest scrubbing occurs when the tuck 20*a* is utilized for the purpose of the present invention or for absorbing deformation upon the surface of pants or skirt (not shown). The triangular attachment 51, preferably made of a tough and smooth material such as leather, provides smoother function of the tuck 20*a* in accordance with the present invention.

Figure 9:
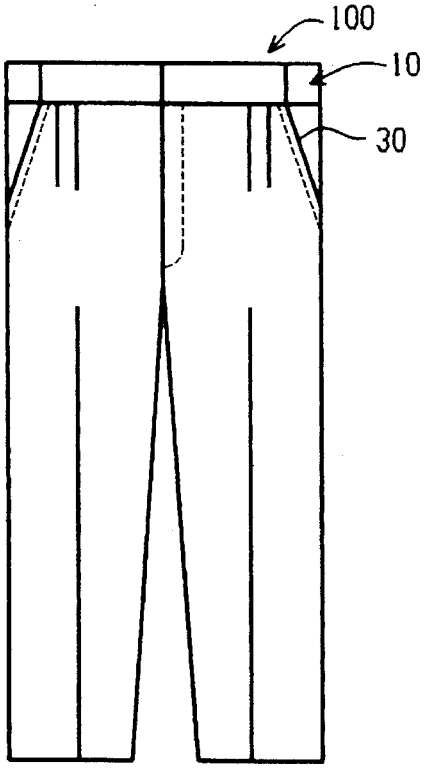
FIG. 9 is a front view of a pair of tucked pants having two elastic waist structures according to another embodiment of the present invention where a pocket is utilized in each elastic waist structure instead of a tuck to absorb wrinkles or furrows.

FIG. 9 shows a pair of tucked trousers 100 where another embodiment of the present invention, similar in a way to the embodiment introduced using FIG. 2, is adopted. The aforedescribed function of the first tuck 20*a* and its inner fabric 23 of FIG. 2 are here taken over by a pocket 30 and its inner side 30' (FIG. 10).

Figure 10:
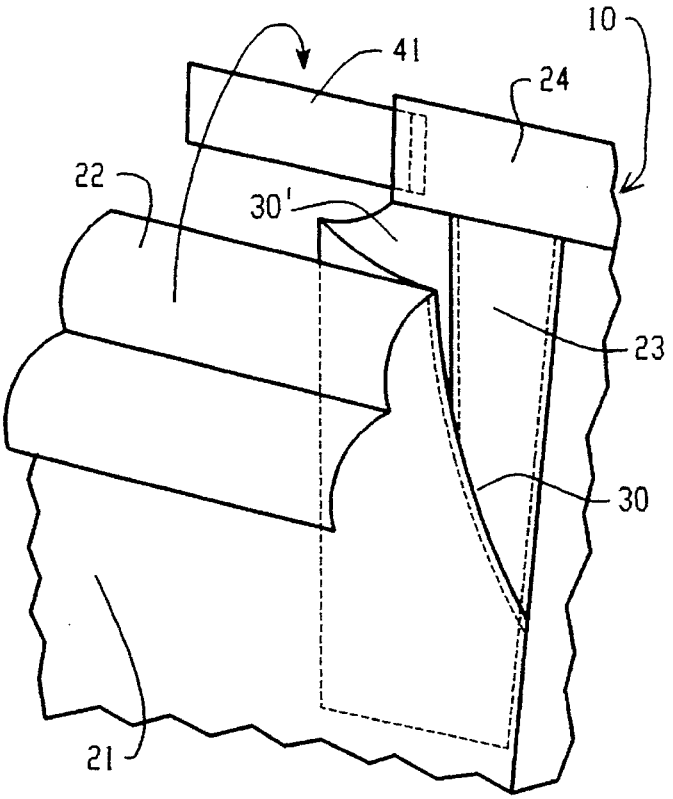
FIG. 10 is a partial perspective view showing the elastic waist structure of this embodiment where the fabric cover is broken away.

As shown in FIG. 10, the pocket 30 having the inner side 30' whose top edge is unsewn and can open absorbs and eliminates forming of wrinkles or furrows outside the pants 100 as the pocket 30 or the outer fabric 21 moves sideways when the elastic strip material 41 contracts or stretches.

Figure 11A:
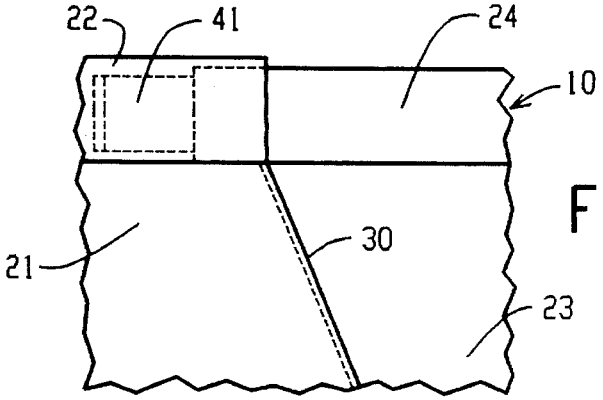
FIG. 11 (A) shows how the elastic waist structure of this embodiment works when the elastic strip material is fully contracted.
Figure 11B:
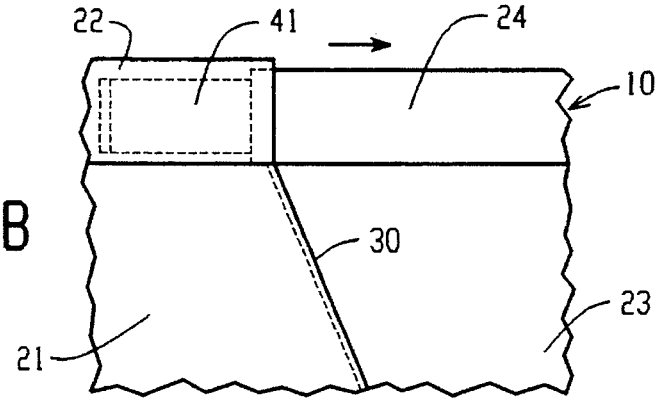

FIGS. 11*a* and 11*b* show how the elastic waist structure of this embodiment works, of which FIG. 11*a* shows the state when the elastic strip material 41 is fully contracted and FIG. 11*b* shows the state when the elastic strip material 41 is fully stretched. The elastic strip material 41 will not show up at all even when the elastic strip material 41 is fully stretched as the elastic strip material 41 is wholly hidden by the fabric cover 22.

Figure 12:
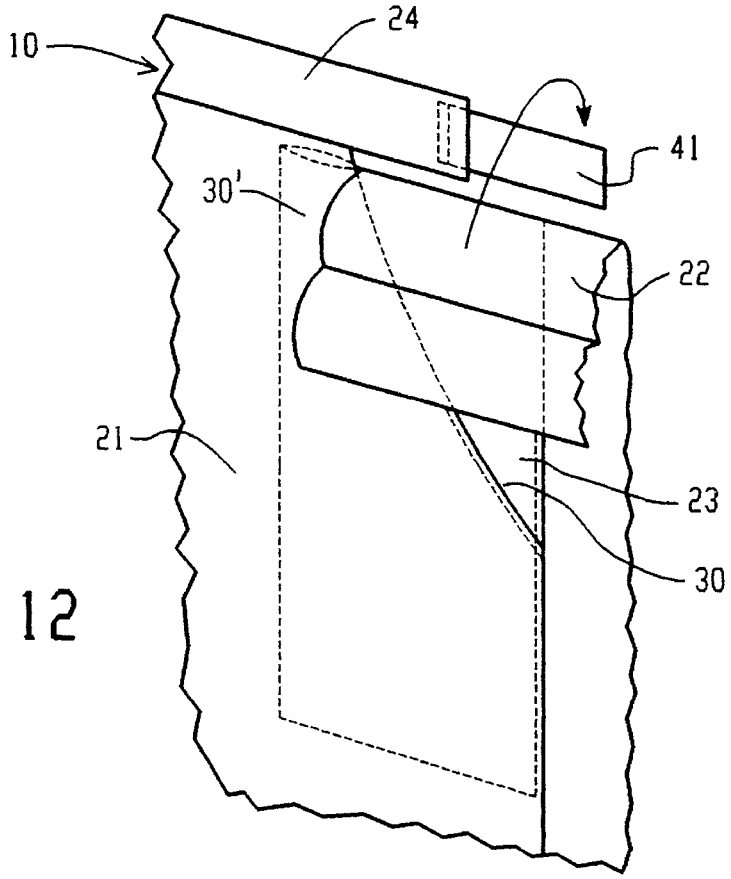
FIG. 12 is a partial perspective view of another embodiment elastic waist structure of the present invention where another embodiment pocket is utilized instead of a tuck to absorb wrinkles or furrows.

FIG. 12 shows another embodiment of the present invention which is a modification of the embodiment shown in FIG. 4, where the function of the first tuck 20*a* with an inner fabric 23 of FIG. 4 is replaced by that of a pocket 30 whose inner side 30' is slidably provided.

Figure 13A:
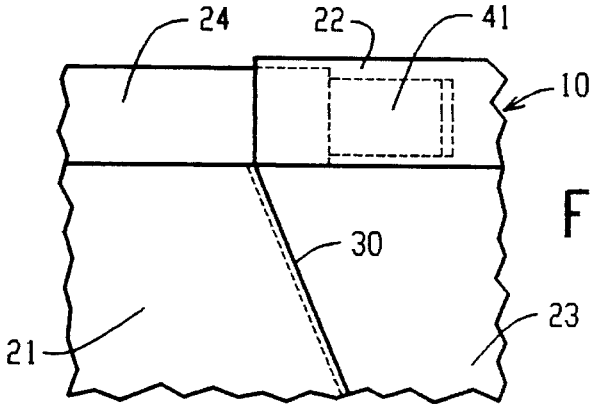
FIG. 13 (A) shows how the elastic waist structure of this embodiment works when the elastic strip material is fully contracted.
Figure 13B:
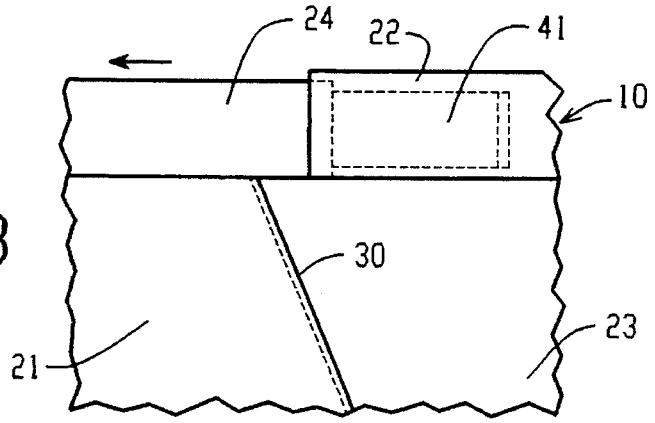

FIGS. 13*a* and 13*b* show the work of the elastic waist structure of this embodiment, of which FIG. 13*a* shows the state when the elastic strip material 41 is fully contracted while FIG. 13*b* shows the state when the elastic strip material 41 is fully stretched. The deformation of the pants or skirt (not shown) resulted from the stretch or contraction of the waist portion of the pants or skirt (not shown) will be absorbed effectively and elegantly by the sideward movement of the inner side 30'.

Figure 14:
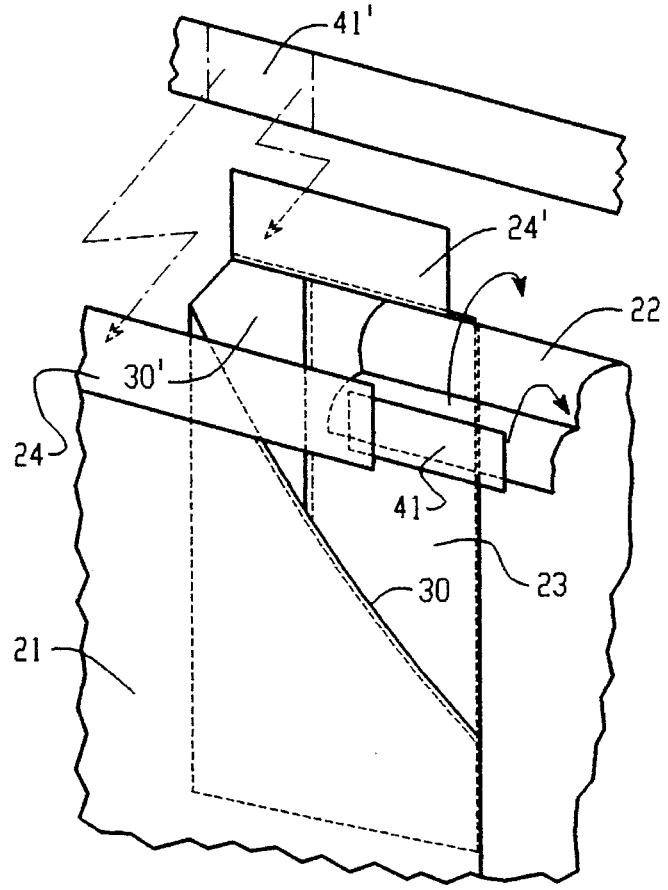
FIG. 14 is a partial perspective view of another embodiment elastic waist structure of the present invention utilizing a pocket and two elastic strip materials.

FIG. 14 shows still another embodiment elastic waist structure according to the present invention which is in a way similar to the embodiment shown in FIG. 6, where the function of the first tuck 20*a* with the inner fabric 23 is here replaced by that of a pocket 30 with its inner side 30'. The elastic strip material 41' in this embodiment is a long beltlike material just to show another example, which is attached at its two places to the waist fabrics 24 and 24', respectively as shown in the figure.

Figure 15A:
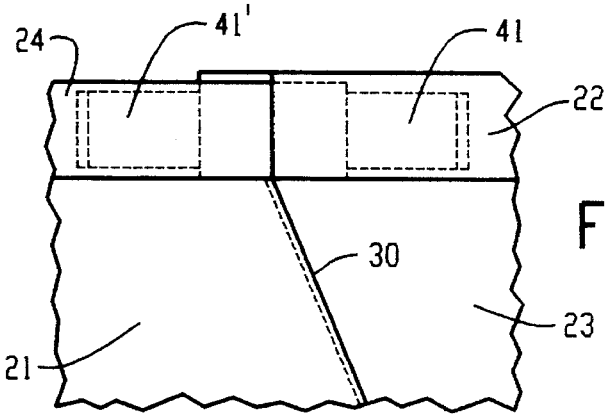
FIG. 15 (A) shows how the elastic waist structure of this embodiment works when the two elastic strip materials are fully contracted.
Figure 15B:
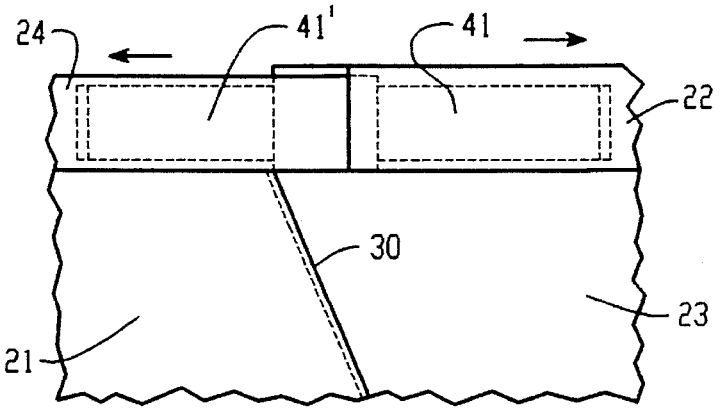

FIGS. 15*a* and 15*b* show how this embodiment works. Both the elastic strip materials 41 and 41' are wholly covered respectively by the fabric cover 22 and the waist fabric 24 even when the two elastic strip materials 41 and 41' are fully stretched. The pocket 30 and its slidable inner side 30' effectively and fashionably eliminate forming of wrinkles or furrows outside the pants or skirt (not shown) as described earlier with the foregoing embodiments having the pocket function of the present invention.

Figure 16:
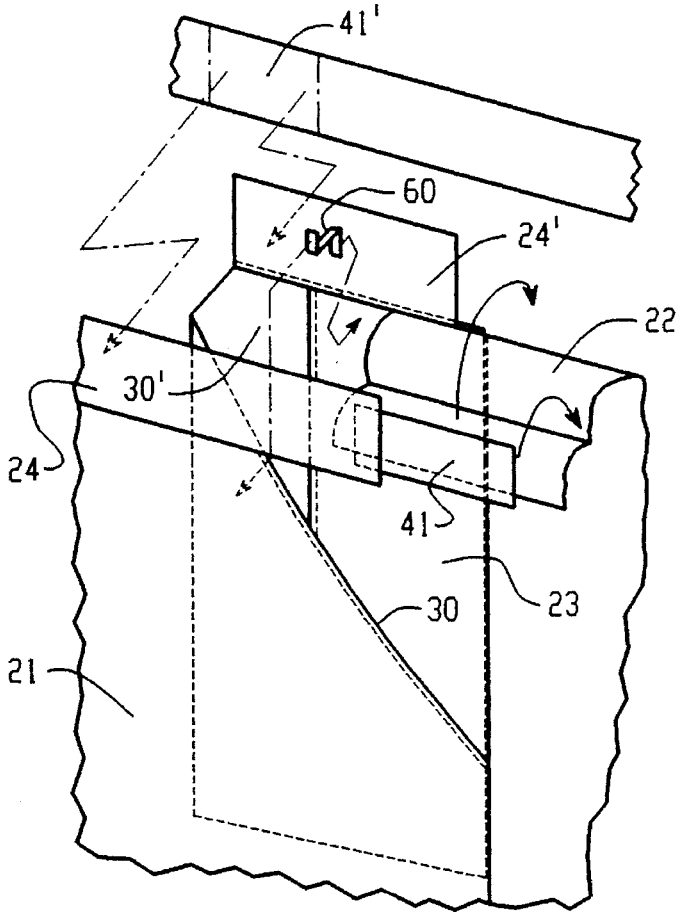
FIG. 16 shows utilization of a wrinkle preventer.

FIG. 16 teaches use of an elastic wrinkle preventer 60 to be provided on a pocket 30 of the present invention, which will help keep the shape of the pocket 30 when the elastic waist structure of the present invention works. The wrinkle preventer 60 here is attached at one end to the waist fabric 24' and at the other end to an upper portion in the back side of the pocket 30. The wrinkle preventer 60 will hold back the pocket 30 when the inner side 30' is pulled sideways as the elastic strip materials 41 and 41' are stretched.

Figure 17:
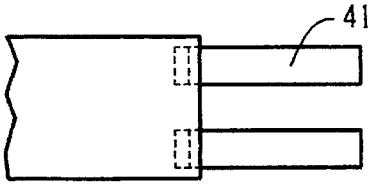
FIG. 17 shows an alternative embodiment elastic strip material of the present invention.
Figure 18:
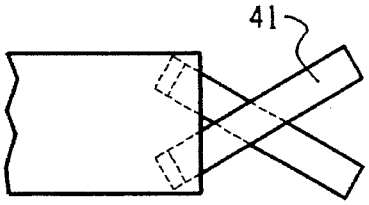
FIG. 18 shows another alternative embodiment elastic strip material of the present invention.
Figure 20:
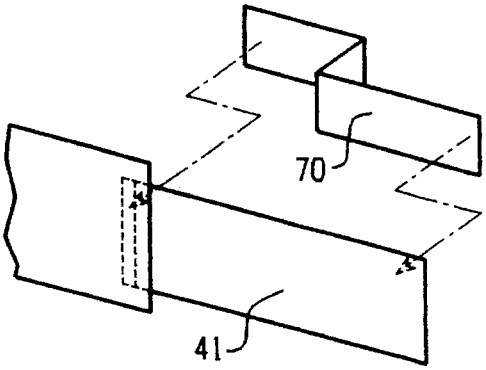
FIG. 20 shows utilization of a stretch stopper.
Figure 19:
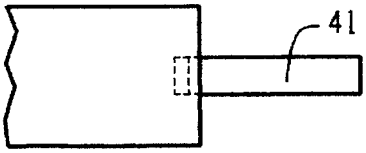
FIG. 19 shows another alternative embodiment elastic strip material of the present invention.

FIGS. 17 to 19 show a few alternative examples of the elastic strip material 41 (41') of the present invention. FIG. 20 shows a stretch stopper 70 which is longer than the contracted elastic strip material 41 or 41' to which the stopper 70 is adopted, and prevents the elastic strip material 41 or 41' from stretching too much, especially when the elastic strip material 41 or 41' is degraded with time and use, losing its elasticity. The stretch stopper 70 may be attached to the elastic strip material 41 or 41' as shown in FIG. 20.

Figure 21:
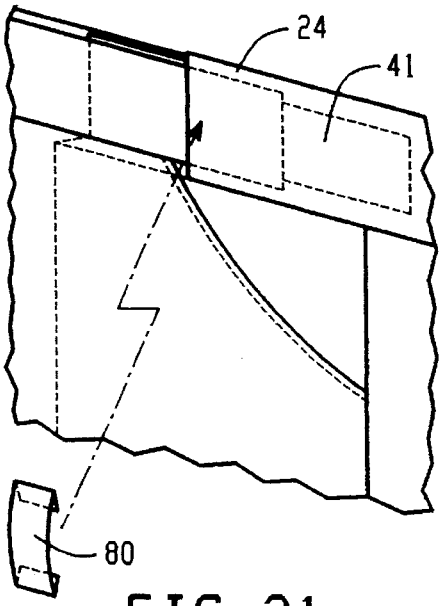
FIG. 21 shows utilization of a belt holder.

FIG. 21 teaches use of belt holders 80. Such a belt holder 80 may be attached to the waist fabric 24 in such a manner so as not to hinder the function of the present invention.

Figure 22:
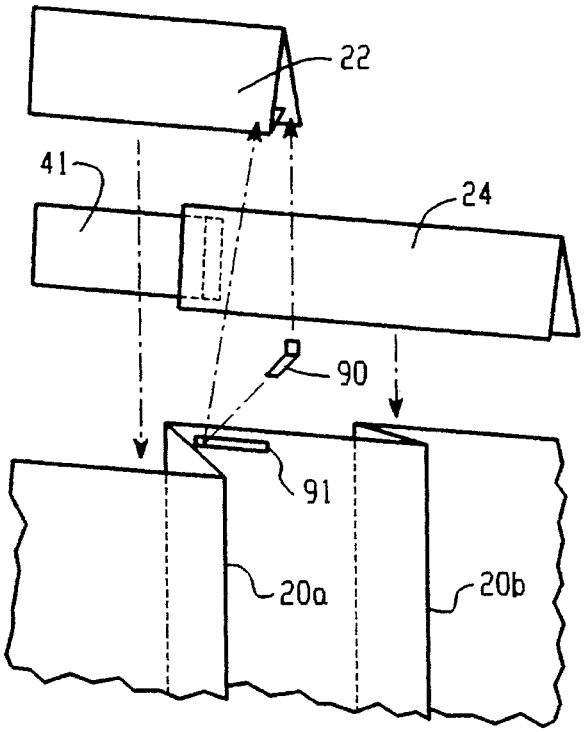
FIG. 22 shows a tuck holding structure.

FIG. 22 shows alternative examples of the fabric cover 22 and the waist fabric 24 of the present invention. Unlike the previously described fabric cover 22, the fabric cover 22 may be prepared separately and adopted to the waist portion of pants or skirt as shown in FIG. 22.

FIG. 22 also shows a tuck holder 90 which is sewn or attached below the level of the lower edge of the waist fabric 24, bridging the lower inner sides of the alternative fabric cover 22 through the horizontally extending slit 91 provided within the inner fabric 23 of the first tuck 20*a* at its upper edge portion. The tuck holder 90 moves horizontally within the slit 91. The tuck holder 90 holds or prevents the first tuck 20*a* from opening widely or shapelessly.

Figure 23:
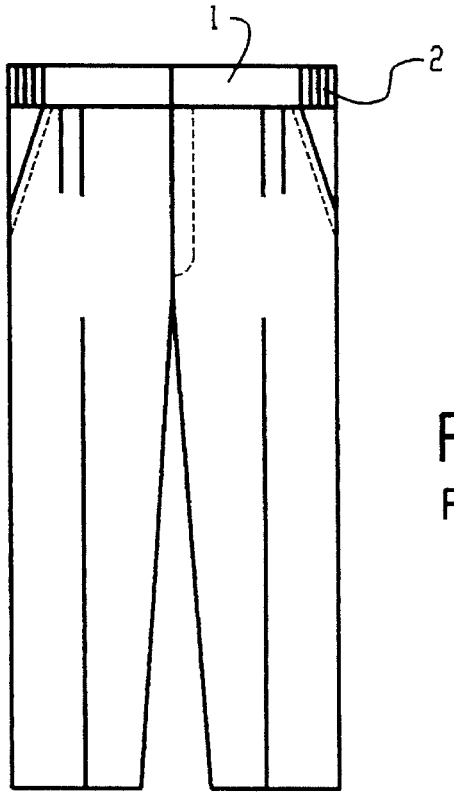
FIG. 23 PRIOR ART
FIG. 23 is a front view of a pair of tucked trousers having conventional elastic waist structures where the elastic strip materials are in sight.

FIG. 23 shows a pair of tucked pants having thereon conventional elastic waist structures. The conventional elastic strip materials 2 used there are in sight on the waist portion 1 of the pants, which is not very graceful. When the elastic strip materials 2 stretch or contract, the upper portions of the pants will be wrinkled and the wrinkles formed on the pants will be in sight.

The present invention has been described above. Various details of the invention may be changed without departing from its scope. Furthermore, the foregoing description of the preferred embodiments is provided for the purpose of illustration only and not for the purpose of limitation—the invention being defined by the claims.

What is claimed is:

1. An elastic waist structure for a pair of pants or skirt, comprising a tuck having inner fabric whose top edge is unsewn, an elastic strip material, and a fabric cover wide enough to cover any stretched length of said elastic strip material, said inner fabric capable of moving sideways below the waist portion of the pants or skirt as said elastic strip material changes in length, and said elastic strip material covered with said fabric cover attached at its rear end to the waist portion and at its front end to the back side of said fabric cover, such that when the waist portion is pulled rearwards stretching said elastic strip material rearwards behind said fabric cover, said inner fabric of said tuck eliminates forming of wrinkles or furrows outside the pants or skirt.

2. An elastic waist structure for a pair of pants or skirt, comprising a tuck having inner fabric whose top edge is unsewn, an elastic strip material, and a fabric cover wide enough to cover any stretched length of said elastic strip material, said inner fabric capable of moving sideways below the waist portion of the pants or skirt as said elastic strip material changes in length, and said elastic strip material covered with said fabric cover attached at its front end to the waist portion and at its rear end to the back side of said fabric cover, such that when the waist portion is pulled forwards stretching said elastic strip material forwards behind said fabric cover, said inner fabric of said tuck eliminates forming of wrinkles or furrows outside the pants or skirt.

3. An elastic waist structure for a pair of pants or skirt, comprising a tuck having inner fabric whose top edge is unsewn, a first elastic strip material, a second elastic strip material, a waist portion having a waist fabric, and an additional waist fabric and a fabric cover wide enough to cover any stretched length of said first elastic strip material, said inner fabric capable of moving sideways below the waist portion of the pants or skirt as said elastic strip materials change in length, said first elastic strip material covered with said fabric cover attached at its front end to the waist fabric and at its rear end to the back side of said fabric cover, said second elastic strip material covered, with said waist portion attached at its front end to the waist front end of the fabric and at its rear end to the front end of said additional waist fabric, and said additional waist fabric attached at its rear end to the back side of said fabric cover, such that when the waist portion is widened stretching said elastic strip materials behind said fabric cover and waist portion, respectively, said inner fabric of said tuck eliminates forming of wrinkles or furrows outside the pants or skirt.

4. An elastic waist structure according to claim 1, wherein said tuck and said inner fabric are respectively replaced by a pocket and slidable inner side.

5. An elastic waist structure according to claim 2, wherein said tuck and said inner fabric are respectively replaced by a pocket and slidable inner side.

6. An elastic waist structure according to claim 3, wherein said tuck and said inner fabric are respectively replaced by a pocket and slidable inner side.

* * * * *